US008161756B2

(12) United States Patent
Kutta et al.

(10) Patent No.: US 8,161,756 B2
(45) Date of Patent: Apr. 24, 2012

(54) DUAL COMPARTMENT BEVERAGE COOLING SYSTEM

(75) Inventors: Andrew Kutta, St. Louis, MO (US); Matthew Wootton, St. Louis, MO (US); Asdrubal Garcia-Ortiz, Chesterfield, MO (US)

(73) Assignee: DRS Sustainment Systems, Inc., St. Louis, MO (US)

( * ) Notice: Subject to any disclaimer, the term of this patent is extended or adjusted under 35 U.S.C. 154(b) by 75 days.

(21) Appl. No.: 11/933,605

(22) Filed: Nov. 1, 2007

(65) Prior Publication Data

US 2008/0216488 A1 Sep. 11, 2008

Related U.S. Application Data

(60) Provisional application No. 60/863,884, filed on Nov. 1, 2006.

(51) Int. Cl.
*F25D 13/06* (2006.01)
*F25D 3/08* (2006.01)
*F25D 25/04* (2006.01)

(52) U.S. Cl. ..... 62/63; 62/457.5; 221/150 R

(58) Field of Classification Search ..... 62/457.5, 62/63; 236/91 F, 99 E, 91 E; 221/150 R
See application file for complete search history.

(56) References Cited

U.S. PATENT DOCUMENTS

| | | | | |
|---|---|---|---|---|
| 1,240,321 | A * | 9/1917 | Dickinson | 221/150 R |
| 1,689,054 | A | 10/1928 | Samuels | |
| 4,324,286 | A * | 4/1982 | Brett | 165/202 |
| 4,599,871 | A * | 7/1986 | Fredrixon | 62/378 |
| 4,888,960 | A | 12/1989 | Lara | |
| 4,920,763 | A * | 5/1990 | Provest et al. | 62/378 |
| 5,247,798 | A * | 9/1993 | Collard, Jr. | 62/3.62 |
| 5,749,240 | A * | 5/1998 | McGill | 62/250 |
| 7,024,882 | B2 | 4/2006 | Carmichael et al. | |
| 2005/0056047 | A1 * | 3/2005 | Carmichael et al. | 62/457.5 |

OTHER PUBLICATIONS

International Search Report dated Jun. 3, 2008 corresponding to PCT/US07/83294.

* cited by examiner

*Primary Examiner* — Frantz Jules
*Assistant Examiner* — Daniel C Comings
(74) *Attorney, Agent, or Firm* — Kilpatick Townsend & Stockton LLP

(57) ABSTRACT

A dual compartment cooling device that is designed to cool water, or other beverages, as a batch based on expected demand. This provides for the cooling of beverages which are to be consumed in a subsequent demand cycle at which time it is refilled but allows remaining water to remain "hotter" until it is to be in the next dispense cycle.

20 Claims, 11 Drawing Sheets

DUAL COMPARTMENT BEVERAGE COOLING SYSTEM

CROSS REFERENCE TO RELATED APPLICATION(S)

This application claims benefit of and priority to U.S. Provisional Application Ser. No.: 60/863,884, filed Nov. 1, 2006, The entire disclosure of which is herein incorporated by reference.

BACKGROUND

1. Field of the Invention

The invention relates to cooling devices for liquids. Particularly to cooling devices which are designed to cool bottled, or similarly containered, liquids in a batch fashion, 2. Description of the Related Art Current military operations of the United States are highlighting a problem for workers in arid desert environments. That is, maintaining hydration on extended operations. In high temperatures, especially while wearing heavy equipment and performing physical activity, it is necessary for the human body to take in enough water to prevent dehydration, heat stroke, and other potentially dangerous, and even fatal, heat related conditions. For soldiers operating in these types of environments, this can be a particular problem as they may need to transport significant amounts of water with them and may only have a relatively small vehicle. The problem is not, however, isolated to soldiers. Construction workers, aid and relief workers, and other individuals working or living in these environments can also have similar problems remaining hydrated.

It is recommended that a person consume about one liter of water a day under normal conditions and up to 12 liters of water a day when involved in activities in hot environments. While scientific studies of the lower end of this consumption are not clear as its exact amount, in hot environments one liter every three hours does seem to be a reasonable position. For the most part, transport of water to be drunk has not proven to be a huge problem although in hot environments where there are a number of people needing water can be large. However, getting individuals to drink the water has been problematic. Water will generally heat up when exposed to the elements relatively quickly and the basic transport of water generally results in water which is relatively close to the outside temperature when it is dispensed. While this water can meet the needs of hydration, it is often unpalatable to those drinking it and they may not drink it simply because they do not like the taste and temperature. This can result in individuals suffering from heat related problems even though the prevention is readily available.

It has been recognized that water does not need to be cold to be palatable, but need only be cooler than the outside temperature by a measurable amount. Often this is around 40 degrees less than the ambient temperature. At the same time, individuals are much more likely to drink colder water in hot environments if it is available, than they are to drink warmer water in the same environment. Simply because the colder water is more palatable.

In order to insure that individuals working in these environments stay hydrated, it is desirable to provide chilled water, or other beverages as appropriate, to make sure that the individuals have incentive to remain hydrated. This has, however, been problematic as coolers, refrigerators, and other cooling devices have traditionally relied on cooling their entire contents at the same time.

This can lead to undesirable, and unattainable, power requirements for cooling for groups which are based on-board vehicles or otherwise isolated from power infrastructures.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a dual compartment cooling device that is designed to cool water, or other beverages, as a batch based on expected demand. This provides for the cooling of beverages which are to be consumed in a subsequent demand cycle at which time it is refilled but allows remaining water to remain "hotter" until it is to be in the next dispense cycle.

There is described herein a batched cooling system for bottled liquids, the system comprising; a first compartment which does not include an active cooling element; a second compartment which includes an active cooling element; a transfer mechanism for transferring bottles from said first compartment to said second compartment; and a plurality of bottles, a first batch of said plurality being located in said first compartment and a second batch located in said second compartment; wherein, said second batch of bottles is dispensed as a batch, and a portion of said first batch is allowed to transfer between said first compartment and said second compartment; wherein, said portion of said first batch transferred to said second compartment is allowed to be maintained in said second compartment for a predetermined period of time; wherein, after said predetermined period of time said portion is dispensed as a batch; and wherein, bottles continue to cycle from said first to said second compartment as batches are removed from said first compartment.

There is also described herein, a method for transporting and dispensing cooled water in batches, the method comprising: providing a cooling system, the system comprising: a first compartment which does not include an active cooling element; a second compartment which includes an active cooling element, a transfer mechanism for transferring bottles from said first compartment to said second compartment; and a plurality of bottles, some of which are located in said first compartment and some of which are located in said second compartment, dispensing from said system, as a batch, a portion of said plurality of bottles in said second compartment, allowing an equal number of bottles in said plurality to transfer from said first compartment to said second compartment as were dispensed from said second department in said batch; having said second compartment cool said bottles in said second compartment to a predetermined temperature; and repeating said dispensing, said allowing, and said having.

DESCRIPTION OF THE PREFERRED EMBODIMENT(S)

Figure 1:
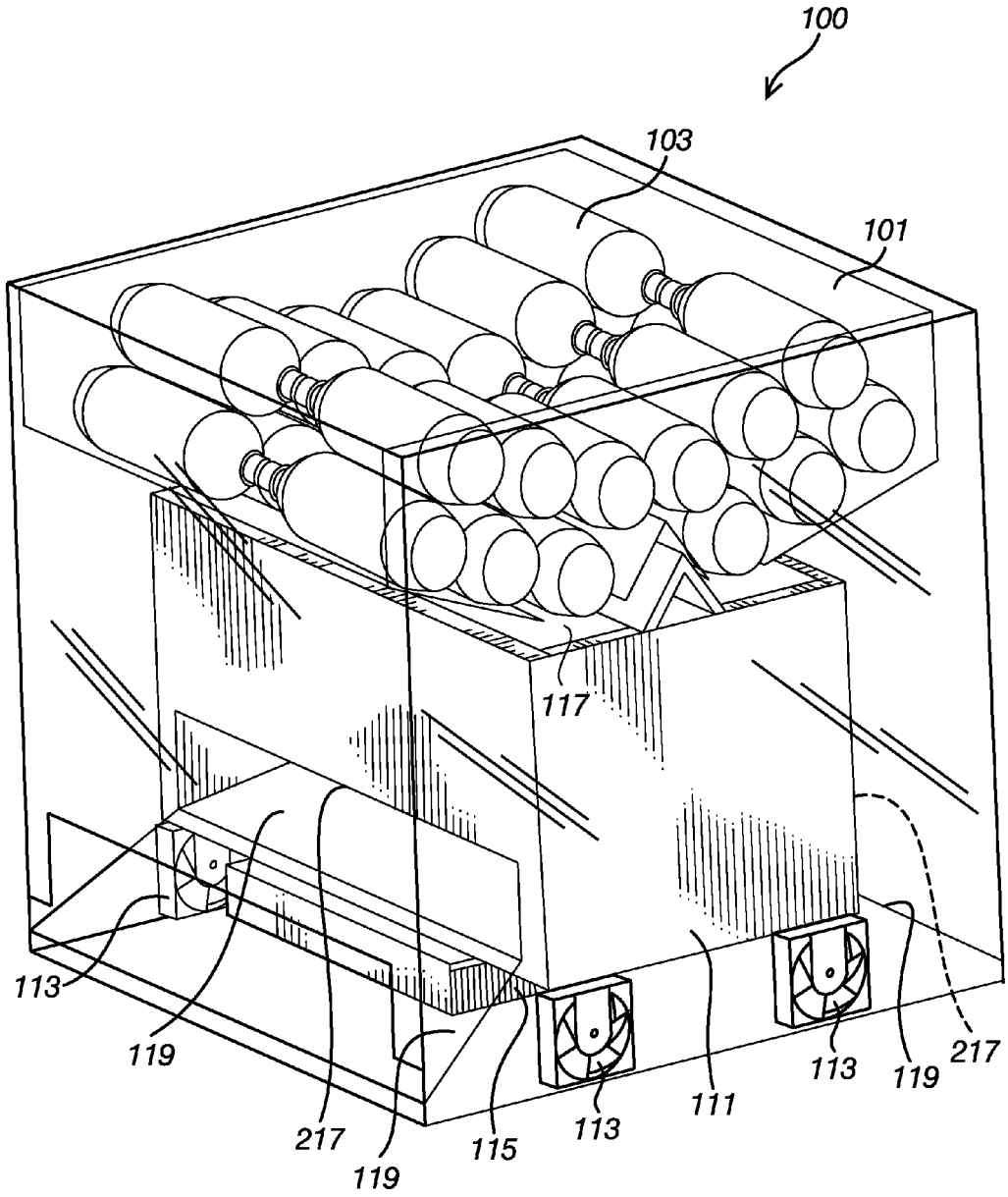
FIG. 1 provides a perspective view of a first embodiment of a dual compartment cooling system including bottles in the first, generally uncooled, compartment.

The following detailed description illustrates by way of example and not by way of limitation. Described herein, among other things, is an embodiment of a batched cooling system which is designed to cool liquids in bottles, cans, or similar containers in a batched fashion, To understand the value of a batched cooling system it is first desirable to understand how hydration under military and other regulated conditions in hot environments is often performed. In order to maintain hydration in such an environment, it is generally desirable for a human being to drink water at a fairly consistent rate. This is maintained in many arid working environments by having a work group, such as a military squad or platoon or a construction worker shift, take regularly scheduled hydration breaks where they will consume a fixed amount of water before returning to work.

What such hydration breaks entail is a group of individuals, often times 5-15 and in the military context generally about 10 obtaining water as a group, consuming the water as a group, and then returning to work, A fixed period of time will then pass and a similar sized group (or the same group) will then repeat the process. This will continue over regular time intervals throughout the day.

A dual compartment cooling system, as discussed herein, is designed to provide for cooled water as it is needed at these hydration breaks, while not cooling more water than is needed between consecutive breaks. This is performed by batch cooling based on expected consumption. Basically, if it is expected that 10 liters of water would be consumed at 3 hour intervals, the system is designed to cool about 10 liters to a desired temperature in about 3 hours, The cooling system(s) described herein perform this by including two compartments. In one compartment, water which is cooled or currently being cooled is stored at a lower temperature. The amount of water in this compartment will correspond to the amount of water which is to be consumed in the next break, or possibly slightly more. There is then provided another compartment which is generally not actively cooled (although it may be passively cooled and/or insulated) which includes additional water bottles. A batch of these bottles are fed into the second compartment when those originally in the second compartment are removed and consumed. Ideally, both compartments utilize passive cooling techniques and insulation so as to utilize as little power as possible to cool the next batch to the desired temperature.

One of ordinary skill in the art will recognize that while the discussion herein will focus on the hydration to be performed by providing water as the beverage in the cooling system, it should be recognized that the system can be used on any beverage that does not require refrigeration for preservation, but which is preferred to be consumed cold. Therefore, the cooling system may dispense other beverages such as soda, sports drinks, energy drinks, fruit juices not requiring refrigeration, and even alcoholic beverages such as beer and wine depending on the embodiment. However, it will generally be the case that water, as a basic beverage, is the most likely to be used and will therefore be used as an exemplary beverage throughout this disclosure.

Figure 2:
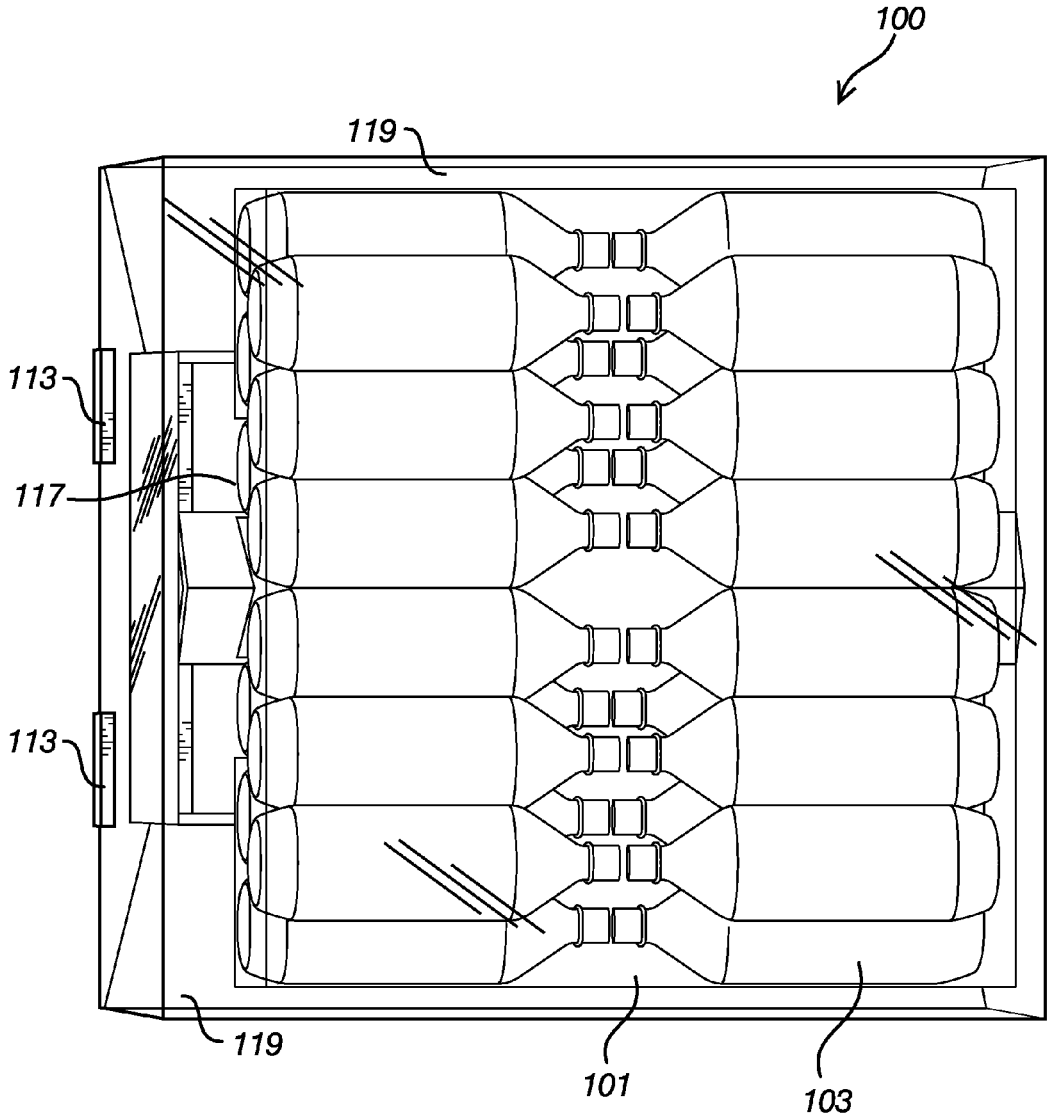
FIG. 2 provides a top view of the embodiment of FIG. 1.
Figure 3:
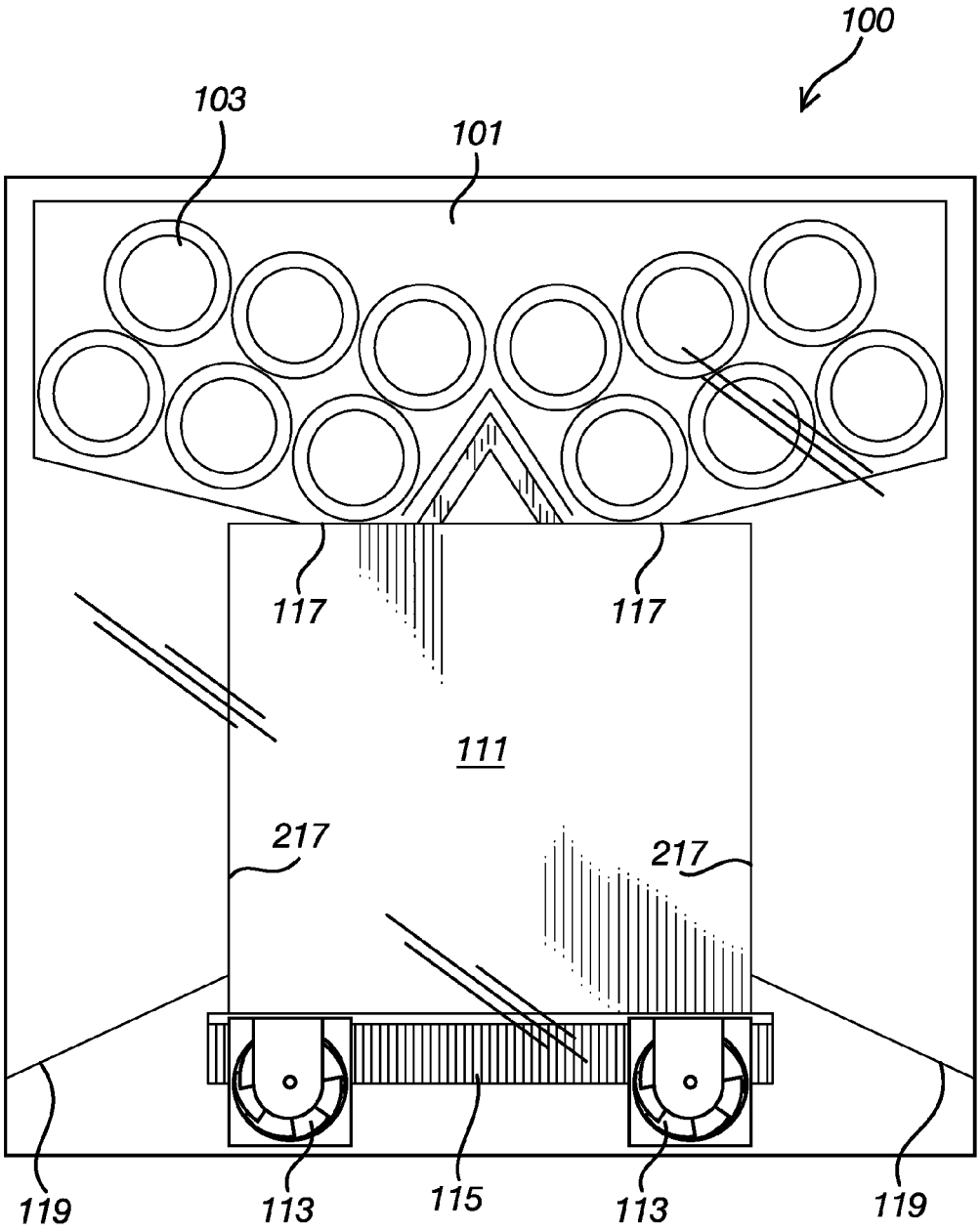
FIG. 3 provides a side view of the embodiment of FIG. 1.

FIGS. 1-3 provide for a first embodiment of a beverage cooler (100) utilizing dual compartments. The first compartment (101) is generally self contained, and does not have an active cooling system. The first compartment (101) may include a passive cooling system and/or insulative property such as having a heat reflective outer surface, insulation or various other types of passive systems but will generally not utilize any cooling system which requires power. Enclosed in the first compartment (101) are a collection of water bottles (103). These bottles have not been actively cooled by the device (100). However, that does not mean they are necessarily at ambient temperature. They may have been cooled prior to being placed in the first compartment (101) and are now simply heating slower than they would outside of the device (100).

There will generally be more water bottles held in the first compartment (101) than would comprise a single cooled batch to be dispensed. In the embodiment of FIGS. 1-3, a batch of bottles to be cooled will comprise 12 bottles which will correspond to an expected consumption of 10 bottles consumed at a time with two extras maintained at a cool temperature. This particular number is by no means required but is often desirable for a military squad having 10 members which will serve as the only consumers of the water from this particular cooler. There are two additional batches, therefore, held in the first compartment (101).

The bottles (103) may be of any size, but will often be one to one-and-a-half liter bottles to correspond to drinking approximately one to one-and-a-half liters of water every three hours. This is generally sufficient for a human to maintain hydration even under hot temperature conditions.

Below the first compartment (101), there is included a second compartment (111) which is the cooling compartment. This second compartment (111) will include one or more forms of active cooling and will be maintained at a cooler temperature than the surroundings and generally at a temperature which makes the water therein more palatable to drink. The second compartment (111) may also include various passive forms of cooling to further improve efficiency of the entire cooling structure.

Cooling mechanisms used in either the first compartment (101) or the second compartment (111) may comprise any mechanisms known to those of ordinary skill in the art including, but not limited to vapor compression, thermoelectric, thermionic, high pressure air, thermoacoustic, magnetic refrigeration, material phase change (including use of eutectic mixes), chemical, Stirling engines, absorption, adsorption, spray evaporative processes, flash evaporation, or any combination thereof. It is generally preferred that vapor phase, Stirling engine, or thermoelectric systems be used for active cooling and eutectic mix material phase change be used as part of passive cooling.

The first (101) and second compartments (111) will also generally both be insulated with any form of insulative material known to the art as is generally understood to insulate a device designed to regulate temperature. This can include, but is not limited to, ABS plastics, Styrofoam™, vacuum insulated paneling, aerogels, carbon fiber, aluminum, synfoam, polypropylene, fiberglass or fiberglass reinforced polyester, air, or any combination of these. In this way, cooled bottles can be placed inside the device from a larger commercial refrigerator where power concerns may not be as great or from other cooling processes such as natural cooling during the night, and then are maintained at a lower temperature throughout transport to provide improved efficiency to the system. In particular, the cooler the water bottles (103) are in the first compartment (101) the less active cooling is required in the second compartment (111) providing for energy savings.

There is also visible in the embodiment of FIGS. 1-3 various heat exchange fans (113) which serve to move heat away from the device (100) to provide for more efficient cooling, as well as a heat sink (115) for similar purpose.

Figure 4:
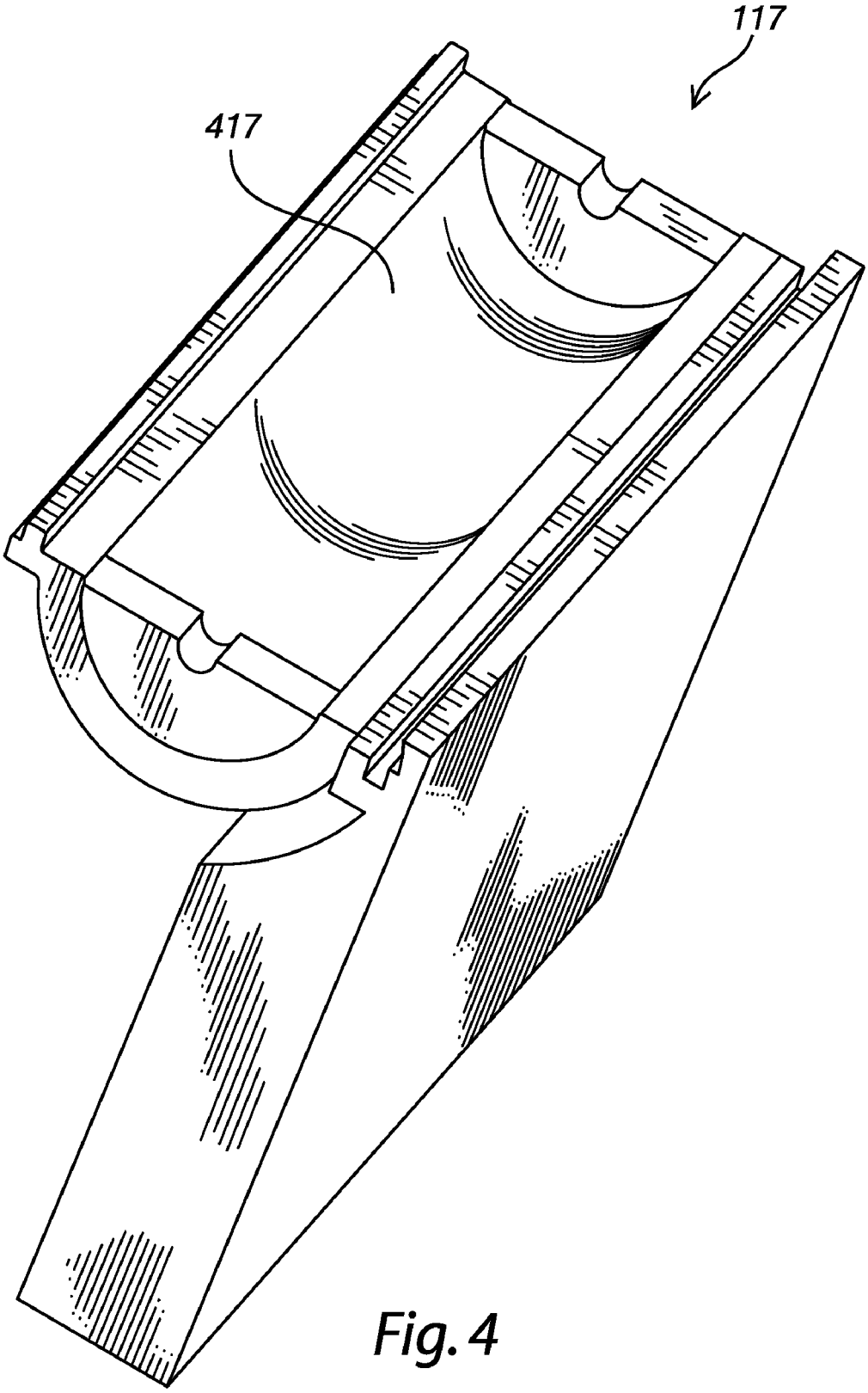
FIG. 4 shows a perspective view of an embodiment of the internal structure of a beverage bottle feeder mechanism.
Figure 5:
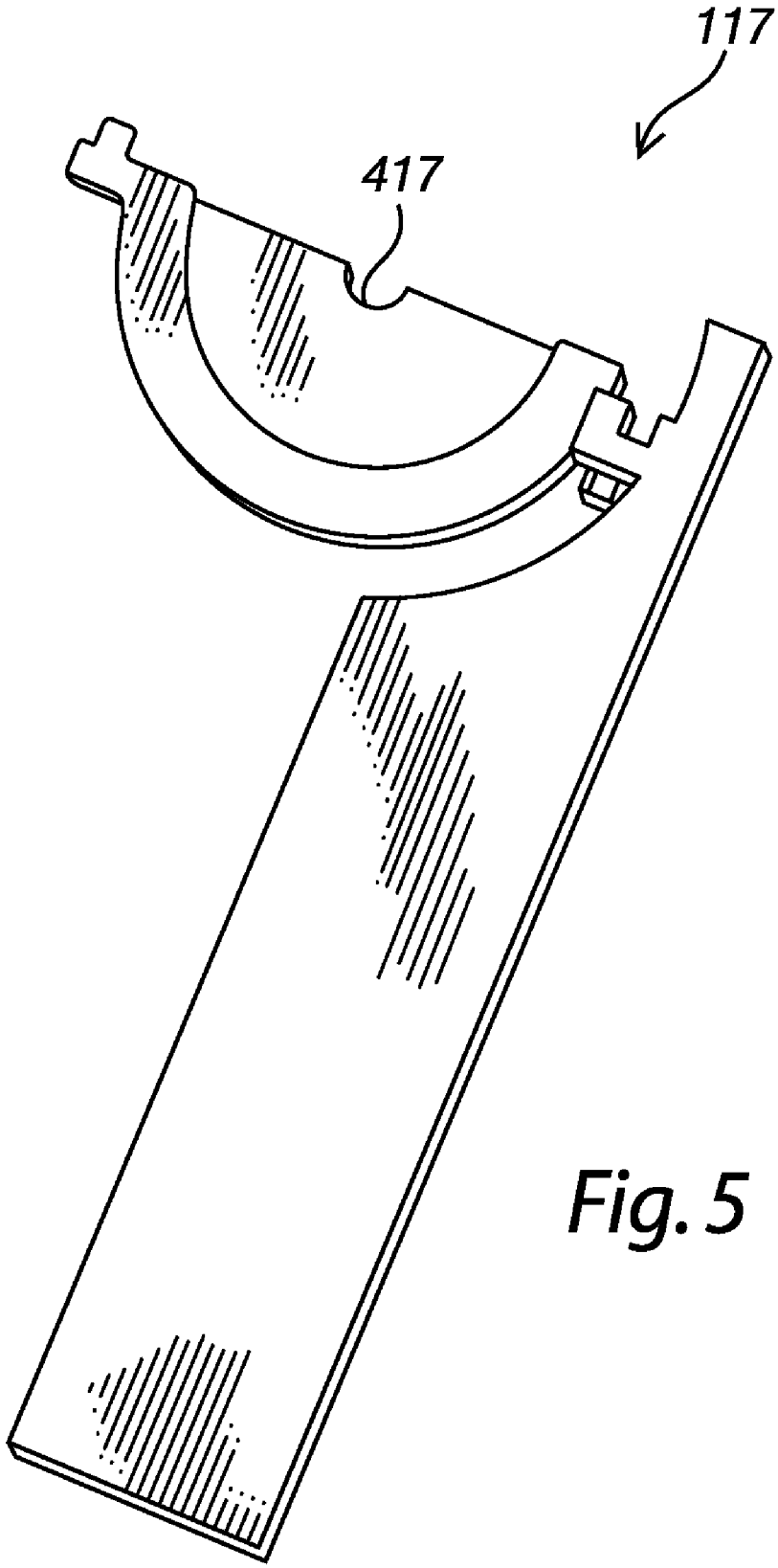
FIG. 5 shows a side view of the embodiment of FIG. 4.

The first compartment (101) and second compartment (111) are generally separated by a feeder mechanism (117). The feeder mechanism (117) is designed to provide for controlled feed of bottles from the first compartment (101) into the second compartment (111), generally in a one-bottle-at-a-time fashion. This is principally to help maintain efficiency by not allowing hotter air into the second compartment (111) from the first compartment (101) any more than is necessary to feed new bottles into the second compartment (111) from the first compartment (101). The feeder mechanism (117) can also provide regulation and organization of bottles (103) so that the users know how many bottles (103) are provided to the second compartment (111) after a consumption event empties or nearly empties the second compartment (111). An embodiment of a feeder mechanism (117) is shown in FIGS. 4 and 5. This feeder mechanism (117) can accept a bottle into a bottle-shaped opening (417) from the first compartment (101) and then rotate, around an axis into the page of FIG. 5, to drop the bottle (103) into the second compartment (111) in a controlled fashion which still providing a partial seal between the two compartments in a manner similar to a revolving door.

Also shown in the embodiment of FIGS. 1-3 are dispensing troughs (119). These troughs (119) serve to be receptacles to receive dispensed bottles from the second compartment (111) which are to be consumed. Again, there will generally be another feeder mechanism (217) for supplying bottles (103) from the second compartment (111) to the trough (119).

Figure 6:
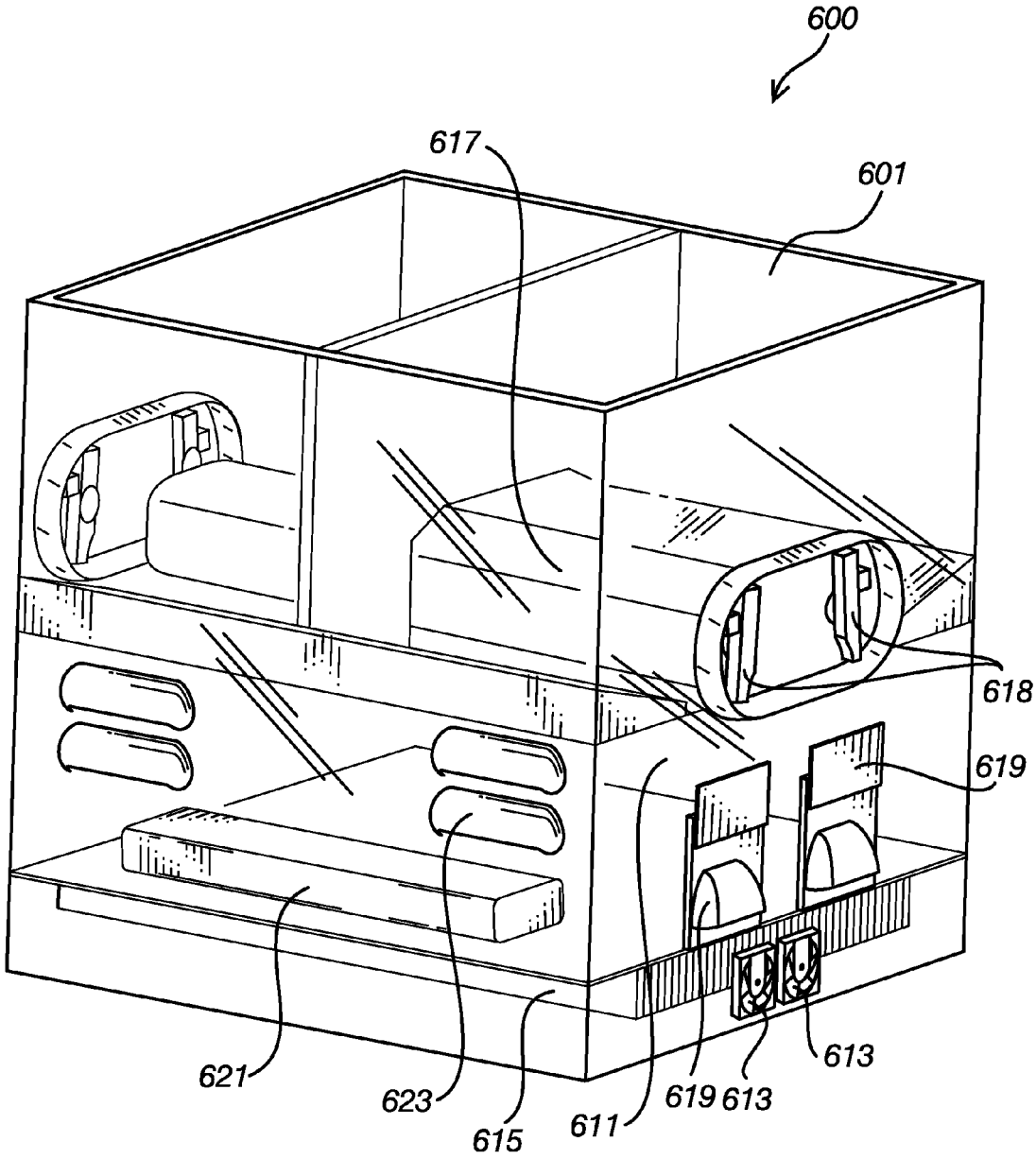
FIG. 6 shows a perspective view of a second embodiment of dual compartment cooling system. A number of components of the outer wall are transparent so as to make internal structure visible.
Figure 7:
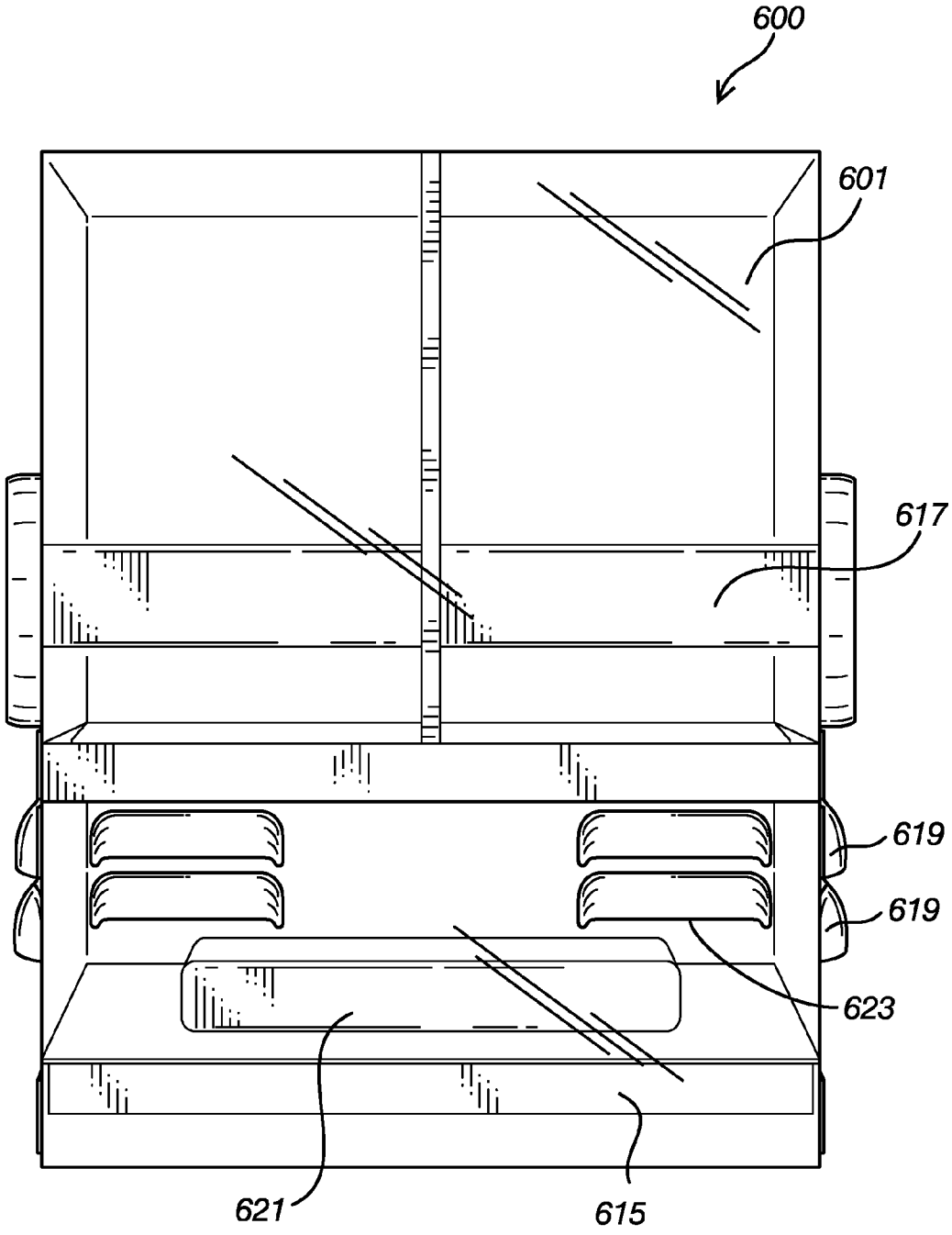
FIG. 7 shows an end view of the embodiment of FIG. 6.
Figure 8:
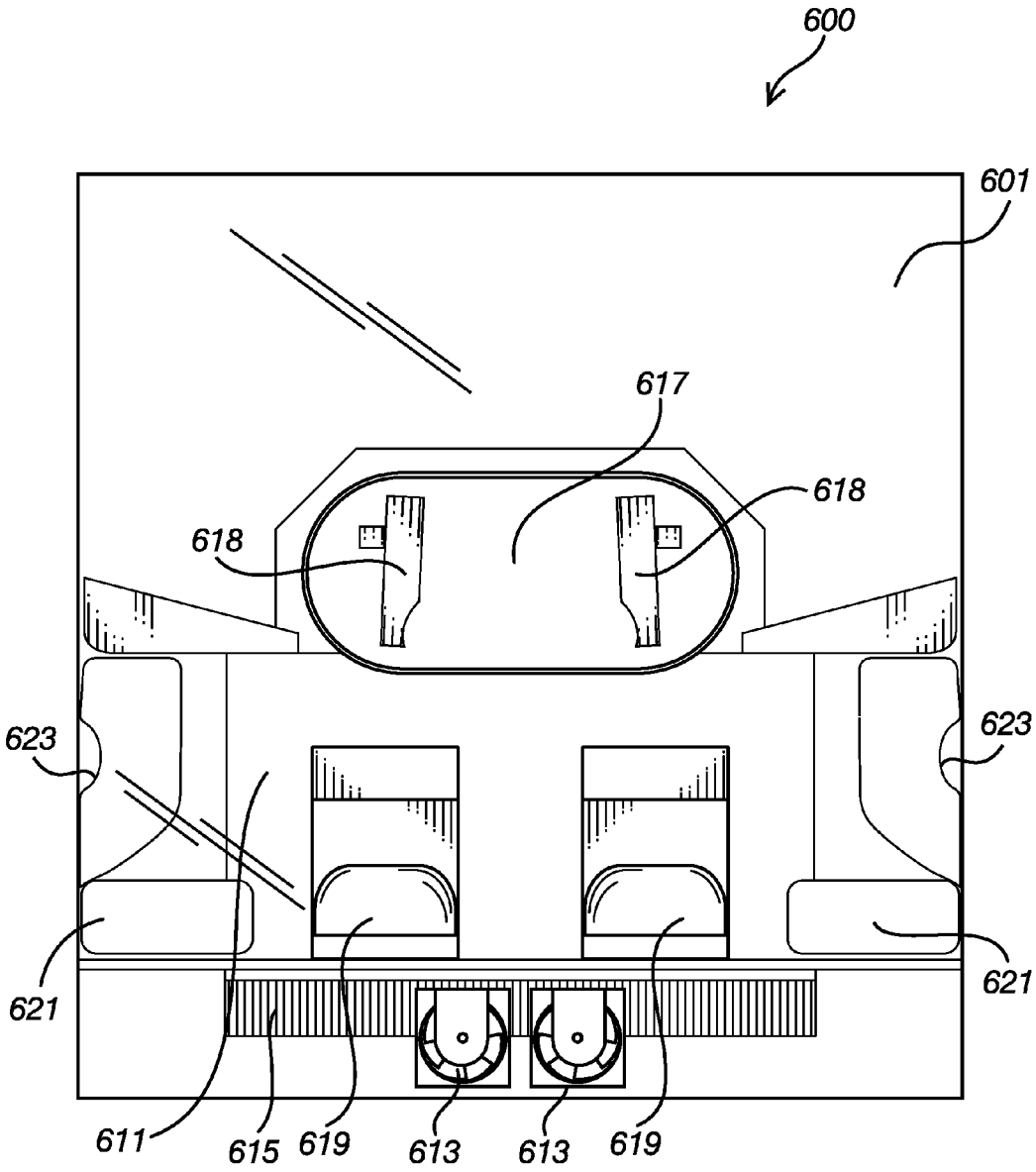
FIG. 8 shows a side view of the embodiment of FIG. 6.

FIGS. 6-8 provide for another embodiment of a dual compartment cooling device (600). Device (600) generally operates on similar principles to device (100) of FIG. 1, but provides for a slightly different layout and dispensing mechanism. Again, there is a first compartment (601) which is generally insulated and may be passively cooled provided in device (600). There is also provided a feeder mechanism (617) for feeding bottles (not shown) into a second compartment (611). The feeder mechanism (617) in this case will generally be hand operated relying on a user to turn a handle (618) to feed bottles into the second compartment (611). In this case utilizing a revolving system as discussed before, although other feeder mechanisms (617) can be used in other embodiments. Fans (613) and a heat sink (615) are again provided for increased cooling efficiency..

Instead of using troughs (119), the device (600) in this embodiment simply provides hinged doors (619), which will generally be biased to their closed position, which allow direct access to the bottles in the second compartment (611). There is also shown a location (621) in this embodiment for electronics or other components related to the active cooling system for the second compartment (611) and carrying handles (623) for easy transport of the device (600).

Both the coolers (100) and (600) will generally provide for multiple stacks of water bottles (103) arranged to provide for multiple access points during dispensing and consumption. This is by no means required, but generally provides for easier dispensing as any bottle (103) to be dispensed is presented at the door (619) or trough (119) without need to reach or search and multiple dispensing locations can improve dispensing speed. Further, in both depicted embodiments, the bottles (103) are dispensed from the lowest portion of the second compartment (611) or (111). In particular, lower bottles (103) are dispensed prior to bottles (103) located higher. This can serve to make sure that the coldest bottles (103) are always dispensed first. As warm bottles(103) are added from above, as seen in the FIGs., in the event that a bottle (103) is not dispensed at a particular dispensing event, that bottle (103) will be at a lower position and ready for immediate dispensing in the next dispensing event. Further, as heat generally rises, even without such a bottle (103), if the bottles (103) have not completely cooled by the time they are dispensed, the lowest bottles (103) will still generally be the coldest.

Figure 9:
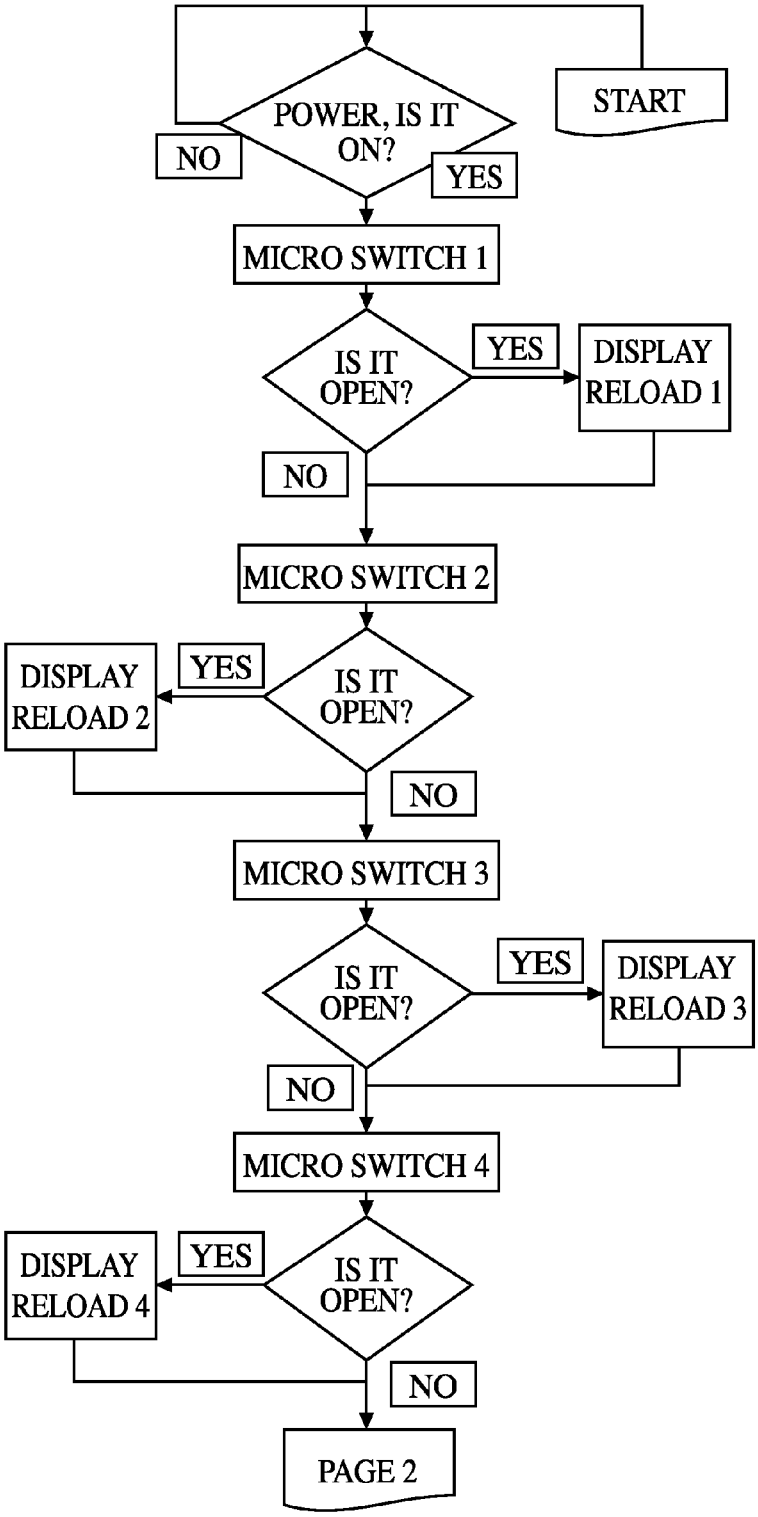
FIGS. 9-11 show a flowchart indicating a possible logic process for whether to actively cool the cooling compartment of a dual compartment cooling system to maintain water at a palatable temperature.
Figure 10:
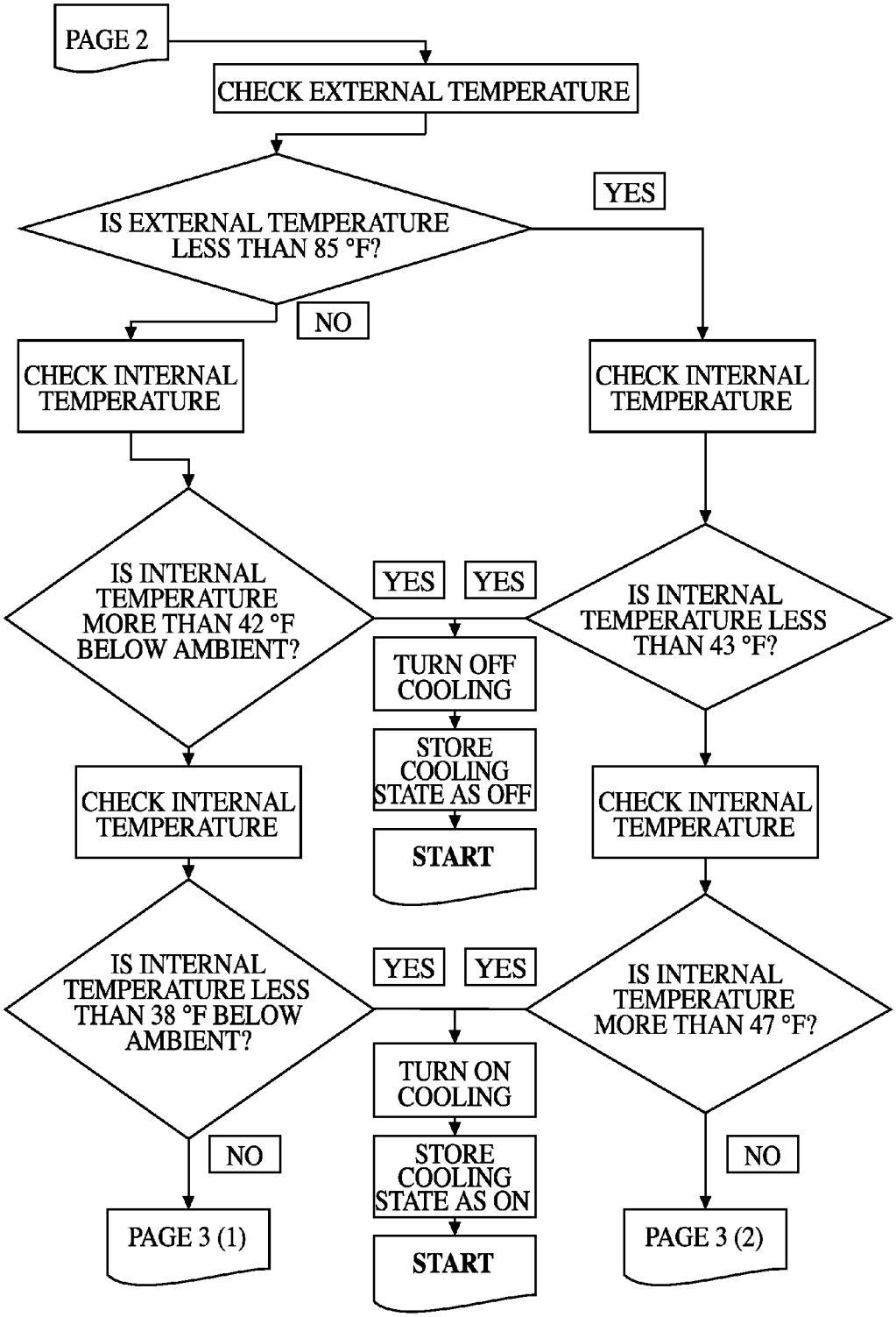
Figure 11:
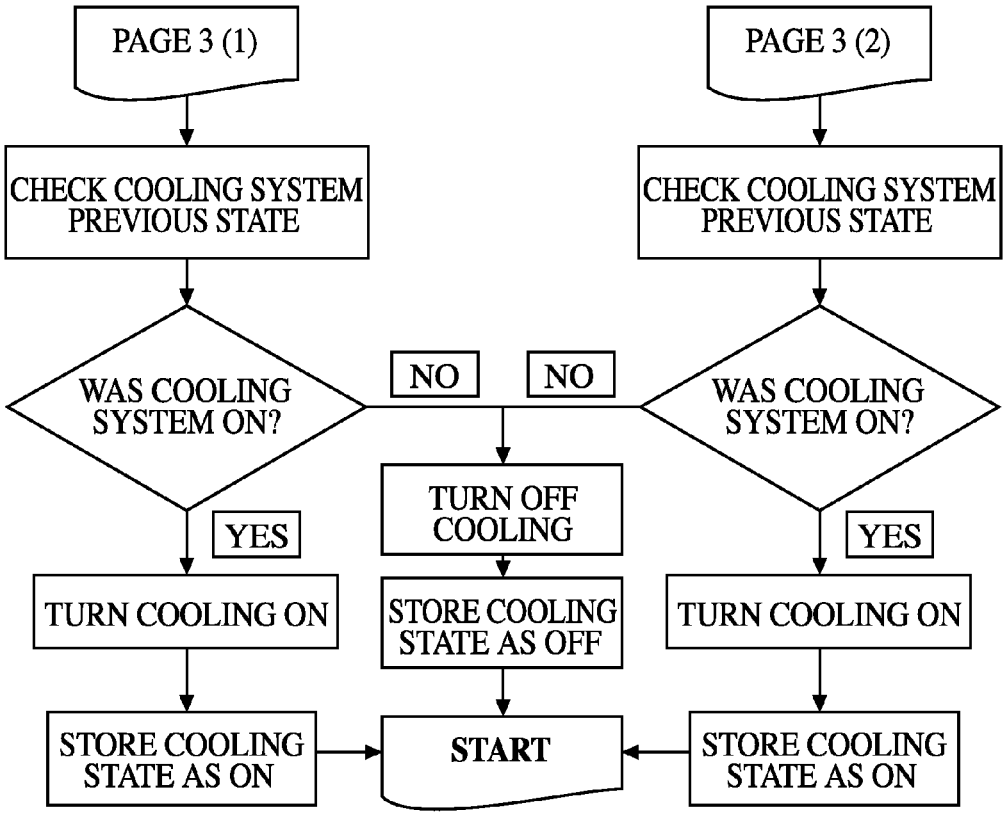

FIGS. 9-11 provide for a flowchart for an embodiment of a logical control of the active cooling mechanism (621) of a dual compartment cooling device (100) or (600). The flowchart is designed to provide improved efficiency by keeping the water in the second compartment at a desired temperature, without utilizing unnecessary power to cool more than is necessary to make the water palatable. In particular, the logic can take into account the differentiation between the actual water temperature (as measured by the temperature of the second compartment), and the external temperature to decrease cooling in the event that it is unnecessary as the outside temperature has dropped, or to take into account that water need not necessarily be at a fixed temperature but is often palatable so long as it is a sufficient temperature below ambient. In this way, if the external temperature drops and hydration may become less necessary, the cooler (100) or (600) may actually maintain the water at a warmer temperature as less may be used and a colder temperature may not be necessary.

Further, the cooler (100) or (600) can take into account that new water may already be cooler than ambient, even if not the desired temperature, and not overly cool the bottles (103). The cooler (100) and (600) can also indicate when it needs to have the second compartment (111) or (611) refilled to make sure that chilled water is always available at the next dispensing event. The specific decision points of FIGS. 9-11 are given to be exemplary and are believed to generate water that is palatable over a wide range of exterior temperatures while still conserving energy where possible. However, they are by no means required and, depending on the desired temperature and power availability of the user, may be altered.

In an embodiment for military use in desert environments, water provided as part of the batch, when dispensed, will preferably be dispensed at a temperature which is not less than about 45 degrees Fahrenheit to prevent overly cold water (which could actually inhibit hydration) from being provided, but will otherwise be provided at a temperature which is at least about 40 degrees Fahrenheit below the ambient outside temperature. This water will generally be palatable to most users while still meeting reasonable power demands for a vehicle transported and based cooler (100) or (600). The cooling systems of the second compartment (111) and (611) will also generally be able to cool all water in the compartment which is generally 10 to 15 liters, in accordance with these desired ranges in about 3 hours or less. In this way standard consumption of one to one-and-½ liters every three hours can be maintained.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A batched cooling device for bottled liquids, the device comprising;

a first compartment which does not include an active cooling element;

a second compartment thermally separated from the first compartment which includes an active cooling element;

a transfer mechanism for transferring bottles from said first compartment to said second compartment and for creating a partial seal between the first compartment and second compartment, the transfer mechanism comprising an opening defining a third compartment, the transfer mechanism configured to:

accept one or more bottles into the opening from the first compartment, and feed the one or more bottles from the opening into the second compartment; and a plurality of bottles, a first batch of said plurality being located in said first compartment and a second batch located in said second compartment, wherein said second batch of bottles is dispensed as a batch, and a portion of said first batch is allowed to transfer between said first compartment and said second compartment, said portion of said first batch transferred to said second compartment is allowed to be maintained in said second compartment for a predetermined period of time, after said predetermined period of time said portion is dispensed as a batch, and bottles continue to cycle from said first to said second compartment as batches are removed from said second compartment.

2. The batched cooling device of claim 1 wherein the first compartment is insulated from the outside of the device.

3. The batched cooling device of claim 1 wherein the first compartment is enclosed.

4. A method for transporting and dispensing cooled water in batches, the method comprising:

providing a cooling device, the device comprising:

a first compartment which does not include an active cooling element;

a second compartment thermally separated from the first compartment which includes an active cooling element;

a transfer mechanism for transferring bottles from said first compartment to said second compartment, the transfer mechanism comprising an opening defining a third compartment, the transfer mechanism configured to:

accept one or more bottles into the opening from the first compartment, and feed the one or more bottles from the opening into the second compartment; and a plurality of bottles, some of which are located in said first compartment and some of which are located in said second compartment;

dispensing from said system, as a batch, a portion of said plurality of bottles in said second compartment;

transferring from said first compartment to said second compartment an equal number of bottles in said plurality as were dispensed from said second compartment in said batch;

said bottles in said second compartment to a predetermined temperature; and repeating said dispensing, said transferring, and said cooling.

5. The method of claim 4 wherein the first compartment is insulated from the outside of the device.

6. A dual compartment cooling device, comprising;

a first compartment which does not include an active cooling element and is operatively configured to hold a first plurality of bottles;

a second compartment thermally separated from the first compartment which includes an active cooling element and is operatively configured to hold a second plurality of bottles; and a transfer mechanism disposed between said first and said second compartments and operatively configured to rotate about an axis of the transfer mechanism to transfer at least one of the bottles from said first compartment to said second compartment, the transfer mechanism comprising an opening defining a third compartment, the transfer mechanism configured to:

accept one or more bottles into the opening from the first compartment, and feed the one or more bottles from the opening into the second compartment.

7. A dual compartment cooling device as set forth in claim 6, wherein the transfer mechanism is configured to maintain a sealing arrangement between the first compartment and the second compartment while the transfer mechanism is rotating about the axis such that the sealing arrangement inhibits heat present in the first compartment from transferring to the second compartment.

8. A dual compartment cooling device as set forth in claim 6, further comprising a second transfer mechanism disposed within an external wall of said second compartment and operatively configured to rotate about an axis of the second transfer mechanism to transfer at least one of the bottles out of said second compartment.

9. A dual compartment cooling device as set forth in claim 6, further comprising a control mechanism for controlling the active cooling element, the control mechanism being operatively configured to receive a current ambient temperature external to the device, receive a current internal temperature of the second compartment and to activate the active cooling element based on the external ambient temperature and the current internal temperature.

10. A dual compartment cooling device as set forth in claim 9, wherein the control mechanism is operatively configured to deactivate the active cooling element when the external ambient temperature is less than a first predetermined temperature and the current internal temperature is less than a second predetermined temperature.

11. A dual compartment cooling device as set forth in claim 9, wherein the control mechanism is operatively configured to activate the active cooling element when the external ambient temperature is less than a first predetermined temperature and the current internal temperature is more than a third predetermined temperature.

12. A dual compartment cooling device as set forth in claim 9, wherein the control mechanism is operatively configured to deactivate the active cooling element when the external ambient temperature is equal to or greater than a first predetermined temperature and the current internal temperature is more than a first predetermined temperature range below the current ambient temperature.

13. A dual compartment cooling device as set forth in claim 9, wherein the control mechanism is operatively configured to activate the active cooling element when the external ambient temperature is equal to or greater than a first predetermined temperature and the current internal temperature is less than a second predetermined temperature range below the current ambient temperature.

14. The dual compartment cooling device of claim 6 wherein the first compartment is insulated from the outside of the device.

15. A cooling device comprising:

an enclosed first compartment;

an enclosed and actively cooled second compartment thermally separated from the first compartment;

a plurality of consumable liquid containers, a first batch of the plurality of consumable liquid containers being located in the first compartment and a second batch of the plurality of consumable liquid containers located in the second compartment; and a transfer mechanism for transferring a batch of consumable liquid containers from the first compartment to the second compartment and for creating a partial seal between the first compartment and the second compartment, the transfer mechanism comprising an opening defining a third compartment, the transfer mechanism configured to: accept the batch into the opening from the first compartment, and feed the batch from the opening into the second compartment.

16. The cooling device of claim 15, wherein the first compartment does not include an active cooling element.

17. The cooling device of claim 15, wherein the second compartment includes an active cooling element.

18. The cooling device of claim 15, wherein the second compartment includes an active cooling element and wherein the first compartment is actively cooled.

19. The cooling device of claim 15, wherein the first compartment and the second compartment are insulated from the exterior of the device.

20. The cooling device of claim 15, wherein consumable liquid containers cycle from the first compartment to the second compartment after the second batch of consumable liquid containers are removed from the second compartment.

* * * * *